US011772246B2

(12) United States Patent
Czirjak et al.

(10) Patent No.: US 11,772,246 B2
(45) Date of Patent: Oct. 3, 2023

(54) TOOL BASIC MODULE

(71) Applicant: Robert Bosch GmbH, Stuttgart (DE)

(72) Inventors: Peter Czirjak, Miskolc (HU); Anne Purper, Nuertingen (DE); Laszlo Gergely, Felsoezsolca (HU); Thomas Hampel, Magstadt (DE); Aniko Beres, Eger (HU); Zoltan Varga, Miskolc (HU); Dennis Garcia-Franco, Gerlingen (DE); Timo Etzel, Neuhausen (DE); Bence Simko, Edeleny (HU); Steffen Weber, Filderstadt (DE); Daniel-Philipp Friedmann, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 482 days.

(21) Appl. No.: 16/624,773

(22) PCT Filed: Jun. 14, 2018

(86) PCT No.: PCT/EP2018/065751

§ 371 (c)(1),
(2) Date: Dec. 19, 2019

(87) PCT Pub. No.: WO2018/234134

PCT Pub. Date: Dec. 27, 2018

(65) Prior Publication Data

US 2021/0138617 A1 May 13, 2021

(30) Foreign Application Priority Data

Jun. 22, 2017 (DE) ..... 10 2017 210 474.0
Jun. 12, 2018 (DE) ..... 10 2018 209 307.5

(51) Int. Cl.
*B25B 23/00* (2006.01)
*B25F 5/02* (2006.01)

(52) U.S. Cl.
CPC ..... *B25B 23/0007* (2013.01); *B25F 5/02* (2013.01)

(58) Field of Classification Search
None
See application file for complete search history.

(56) References Cited

U.S. PATENT DOCUMENTS

2002/0020539 A1* 2/2002 Driessen ..... B25F 3/00 173/216
2004/0020539 A1* 2/2004 Liao ..... F04C 11/00 137/565.29

(Continued)

FOREIGN PATENT DOCUMENTS

CN 201493828 U 6/2010
CN 102632487 A 8/2012

(Continued)

OTHER PUBLICATIONS

International Search Report corresponding to PCT Application No. PCT/EP2018/065751, dated Oct. 10, 2018 (German and English language document) (5 pages).

*Primary Examiner* — Brian D Keller
*Assistant Examiner* — Dana Lee Poon
(74) *Attorney, Agent, or Firm* — Maginot, Moore & Beck LLP

(57) ABSTRACT

A tool basic module for use with at least one attachment device includes a drive unit, a main output shaft having a shaft receptacle for at least partially receiving a main input shaft of the attachment device, and a coupling device, which has a mechanical interface for mechanically connecting the attachment device to the main output shaft with respect to driving and an electrical interface for transferring electric power and/or an electric current. The mechanical interface is at least in particular substantially cylindrical and has a plurality of interlocking connection elements, which in (Continued)

particular are uniformly arranged on an outer periphery of the mechanical interface and are provided for torque support of the attachment device.

15 Claims, 6 Drawing Sheets

(56) References Cited

U.S. PATENT DOCUMENTS

2004/0029508 A1* 2/2004 Robson ..... B24B 23/00 451/358
2011/0272172 A1* 11/2011 Lau ..... B25F 5/02 173/170
2013/0008677 A1* 1/2013 Huifu ..... B25D 1/00 173/29
2013/0020106 A1* 1/2013 Kuehne ..... B25F 5/02 173/214
2013/0048711 A1* 2/2013 Burns ..... G06K 1/18 235/375
2013/0058711 A1* 3/2013 Van Der Linde ..... F16M 13/02 403/349
2013/0118767 A1* 5/2013 Cannaliato ..... B25F 5/021 173/29

FOREIGN PATENT DOCUMENTS

CN 103042507 A 4/2013
CN 103912592 A 7/2014
CN 205799420 U 12/2016
DE 10 2012 216 600 A1 4/2014
DE 10 2014 208 494 A1 11/2015
DE 10 2015 201 921 A1 8/2016
DE 20 2015 106 905 U1 3/2017

* cited by examiner

TOOL BASIC MODULE

This application is a 35 U.S.C. § 371 National Stage Application of PCT/EP2018/065751, filed on Jun. 14, 2018, which claims the benefit of priority to Serial Nos. DE 10 2017 210 474.0, filed on Jun. 22, 2017, and DE 10 2018 209 307.5, filed on Jun. 12, 2018, both filed in Germany, the disclosures of which are incorporated herein by reference in their entirety.

BACKGROUND

A tool basic module for use with at least one attachment device, said tool basic module having a drive unit, a main output shaft having a shaft receptacle for at least in part receiving a main input shaft of the attachment device, and a coupling device which for mechanically linking at least one attachment device in terms of drive technology has a mechanical interface on the main output shaft, as well as an electrical interface for transmitting an electric output and/or an electric current, has already been proposed.

SUMMARY

The disclosure proceeds from a tool basic module for use with at least one attachment device, said tool basic module having a drive unit, a main output shaft having a shaft receptacle for at least in part receiving a main input shaft of the attachment device, and a coupling device which for mechanically linking the attachment device in terms of drive technology has a mechanical interface on the main output shaft, as well as an electrical interface for transmitting an electric output and/or an electric current.

It is proposed that the mechanical interface is configured so as to be in particular at least substantially cylindrical and has a plurality of form-fitting elements which are in particular disposed uniformly on an external circumference of the mechanical interface and are provided for supporting a torque of the attachment device.

On account thereof, a tool basic module which is usable in a particularly diverse manner can be provided. Attachment devices having electrical additional functions can be used. Resources such as, for example, an energy supply of the tool basic module, can be used in a particularly economical manner. An additional energy supply for the attachment device can be saved. A high level of comfort for a user and a reliable coupling between the tool basic module and the attachment device can be achieved. An advantageous torque support can be achieved. A "tool basic module" in this context is in particular to be understood to be a device which, conjointly with at least one attachment device coupled to the tool basic module, is provided for configuring a hand-held power tool. "Provided" is to be understood in particular as specially programmed, conceived and/or equipped. An object being provided for a specific function is in particular to be understood that the object fulfils and/or carries out said specific function in at least one application state and/or operating state. A "hand-held power tool" in this context is in particular to be understood to be a hand-guided machine, advantageously however a rechargeable-battery hand-held power tool and/or an at least in part hand-guided kitchen appliance. In particular, the tool basic module is provided exclusively for use with at least one attachment device and thus not for stand-alone use. "Stand-alone use" in this context is in particular to be understood as a use that is independent of the attachment device, in particular a use on its own, for example for driving screws, drilling, grinding, or mixing. In particular, the tool basic module per se cannot be used without an attachment device.

A "shaft receptacle" in this context is in particular to be understood to be an exit of a main output train of the tool basic module, in particular for transmitting a torque and/or a rotating movement to a main drive shaft of the attachment device. The shaft receptacle is preferably configured so as, to be integral to a main output shaft of the tool basic module. The shaft receptacle for transmitting a torque and/or a rotating movement to the main input shaft of the attachment device has in particular a polygonal cross-section and/or a plurality of entrainment elements, in particular entrainment webs. The shaft receptacle preferably has a main output axis which is, for example, established by a rotation axis of the main output shaft. The shaft receptacle is preferably configured as a plug-fit receptacle. In order for the tool basic module to be used with the attachment device, the tool basic module has a coupling device having a mechanical interface and an electrical interface.

The tool basic module, apart from the drive unit and the main output shaft having the shaft receptacle as well as the coupling device, comprises in particular also a gearbox unit. The gearbox unit is in particular configured for adapting, in particular for decreasing and/or increasing, a rotating speed of the drive unit. The gearbox unit is in particular embodied as a reduction gearbox unit by way of which the rotating speed of the drive unit is adapted to a lower rotating speed of the main output shaft of the tool basic module. In particular, the drive unit in at least one operating state provides a toque for driving the main output shaft. The main output shaft preferably runs so as to be at least substantially parallel with a main operating direction of the tool basic module. "Substantially parallel" here is in particular to be understood as an alignment of one direction relative to a reference direction, in particular in one plane, wherein the direction in relation to the reference direction has a deviation of in particular less than 8 degrees, advantageously less than 5 degrees, and particularly advantageously less than 2 degrees. Directional indications such as "axial", "radial", and "in the circumferential direction" are to be understood so as to relate in particular to a direction of main extent of the main output shaft. "Axial" herein is in particular to be understood in the direction of the main output shaft. "Radial" is to be understood to be outward, in a manner perpendicular to the main output shaft, along a straight line which intersects the main output axis. "In the circumferential direction" is to be understood as along a circle in a plane that is perpendicular to the main output shaft. A "coupling device" in this context is in particular to be understood to be a device which is provided for connecting the tool basic module, in particular a housing of the tool basic module, to the attachment device, in particular a housing of the attachment device, in a releasable manner, in particular in a tool-free releasable manner. The coupling device effects a releasable electrical and mechanical link between the attachment device and the tool basic module, said link in particular being releasable in a tool-free manner. The coupling device has a mechanical interface. The mechanical interface is provided for effecting a mechanical link between the attachment device and the main output shaft in terms of drive technology. In particular, the mechanical interface effects a transmission of torque from the shaft receptacle to the attachment device, in particular to a main input shaft of the attachment device. The mechanical rater face has in particular one locking unit by way of which the tool basic module, in particular the housing of the tool basic module, is capable of being connected in a releasable mechanical manner, in particular a tool-free releasable mechanical manner, to the attachment device, in particular the housing of the attachment device. The locking unit effects in particular axial securing of the attachment device, in particular of the housing of the attachment device, on the tool basic module, particular the housing of the tool basic module. To this end, the locking unit has at least one securing element for axial securing. The at least one securing element for axial securing can in particular be configured as a force-fitting and/or form-fitting securing element. The locking unit furthermore has in particular one unlocking element. The unlocking element is in particular provided for releasing the locking mechanism of the attachment device on the tool basic module. The unlocking element is in particular manually activatable by the user. The unlocking element in an exemplary manner is embodied as a pushbutton. The unlocking element is preferably provided on the attachment device.

The mechanical interface is in particular at least in part configured as a cylindrical, in particular at east substantially circular-cylindrical, appendage of a housing of the tool basic module that in a main operating direction of the tool basic module extends along a direction of main extent of the main output shaft. The mechanical interface is in particular attached to the housing of the tool basic module, or is at least in part configured by the housing of the tool basic module, and/or is at least in part configured so as to be integral to the housing of the tool basic module. In particular, the mechanical interface has a smaller diameter in comparison to a maximum diameter of a part of the housing of the tool basic module that extends along the direction of main extent of the main output shaft. The mechanical interface has in particular a diameter which is smaller by at least 2 mm, preferably at least 5 mm, and preferably at least 8 mm, than the maximum diameter of the part of the housing of the tool basic module that extends along the direction of main extent of the main output shaft. The part of the housing of the tool basic module that extends along the direction of main extent of the main output shaft has in particular a maximum diameter of at least substantially 40 mm, preferably of at least substantially 45 mm, and preferably of at least substantially 50 mm. The mechanical interface has in particular a diameter of at least substantially 35 mm, preferably of at least substantially 40 mm, and preferably of at least substantially 45 mm. The form-fitting elements of the mechanical interface of the tool basic module for torque support are in particular provided for interacting with corresponding form-fitting elements of the attachment device. The form-fitting elements are in particular incorporated as material clearances and/or recesses in a shell face of the mechanical sectional face, as material protrusions on a shell face of the mechanical interface, and/or configured as flattenings of a shell face of the mechanical interface. In particular, the mechanical interface can have a plurality of form-fitting elements of identical type. The mechanical interface preferably has form-fitting elements of different types. The form-fitting elements extend in particular so as to be parallel with a direction of main extent of the main output shaft. In particular, the mechanical interface has at least two form-fitting elements of identical type, and at least one form-fitting element which is different from the two form-fitting elements of identical type. The form-fitting elements extend across an entire extent of the mechanical interface, in particular along a direction of main extent of the main output shaft.

The electrical interface is provided for transmitting an electric output and/or an electric current, in particular from the tool basic module to the attachment device. The mechanical interface and the electrical interface are preferably provided for being closed in the same closing movement. The coupling device is preferably provided for causing a mechanical link and an electrical link between the attachment device and the tool basic module. For example, the coupling device can be provided for establishing the mechanical and electrical link as the result of a substantially rectilinear movement of the attachment device relative to the tool basic module. In particular, the tool basic module has a power supply which in at least one operating state provides a current for supplying the electrical interface.

It is furthermore proposed that the mechanical interface has three form-fitting elements which are disposed so as to be in each case offset by 120° on the external circumference of the mechanical interface. On account thereof, an advantageous alignment of the attachment device on the tool basic module, and an advantageously reliable torque support, in particular an advantageous distribution of force, can be achieved. In particular, twisting of the attachment device relative to the tool basic module can advantageously be prevented. The mechanical interface has in particular two form-fitting elements of identical type which are configured as material clearances or recesses in the shell face of the mechanical interface. The two form-fitting elements of identical type have in particular an at least substantially triangular cross section. In particular, the two form-fitting elements of identical type are provided for receiving two form-fitting elements of the attachment device that are configured in a corresponding manner. The mechanical interface furthermore has a form-fitting element which is configured as a flattening of the shell face of the mechanical interface. The form-fitting element configured as a flattening is in particular provided for bearing on a planar form-fitting element of the attachment device that is configured in a corresponding manner.

It is furthermore proposed that the mechanical interface has at least one end face which runs so as to be at least substantially perpendicular to the main output shaft and in which a plurality of locking openings which are provided for receiving locking hooks of the attachment device are disposed. On account thereof, advantageously simple and/or secure fastening of the attachment device to the tool basic module can be achieved. The mechanical interface has in particular a number of locking openings that corresponds to a number of locking hooks of the attachment device. The end face is in particular formed by a cover face of the cylindrical mechanical interface. The mechanical interface of the tool basic module preferably has three locking openings which are disposed so as to be in each case mutually offset by 90° about the main output shaft of the tool basic module. In particular, the locking openings have in each case at least one locking edge which in an assembled state of the attachment device is provided for being engaged from behind by the locking hooks of the attachment device. It is furthermore proposed that the mechanical interface has at least one end face which runs so as to be at least substantially perpendicular to the main output shaft, wherein all interface elements of the mechanical interface and/or of the electrical interface and/or the shaft receptacle terminate so as to be at least substantially flush with the end face. An advantageously robust mechanical interface can be provided on account thereof. In particular, damage to interface elements, for example when the tool basic module is dropped, can advantageously be prevented. Advantageously, all interface elements of the mechanical interface and of the electrical interface are at least in part disposed in a plane which intersects the shaft receptacle and which runs so as to be at least substantially perpendicular to the main output shaft. In particular, the plane intersects the shaft receptacle as well as all interface elements of the mechanical interface and of the electrical interface. An advantageously compact construction mode of the coupling device and thus of the entire tool basic module can be achieved on account thereof.

It is furthermore proposed that the shaft receptacle has a receptacle clearance which extends along the direction of main extent of the main output shaft and which has a diameter of at most 7 mm. On account thereof, an introduction of unsuitable tool bits into the receptacle clearance can be advantageously impeded and/or prevented, on account of which an advantageously high operational safety can be achieved. The receptacle clearance is in particular provided for at least in part receiving a main input shaft of the attachment device, said main input shaft having an external geometry that corresponds to an internal geometry of the receptacle clearance. The receptacle clearance can in particular have an arbitrary polygonal cross-section, wherein a diameter of the circumscribed circle and/or the inscribed circle of the polygonal cross-section is at most 7 mm. The receptacle clearance preferably has an at least substantially circular cross-section having a diameter of at most 7 mm.

The receptacle clearance has in particular a plurality of entrainment elements which are disposed on an internal circumference of the receptacle clearance and are provided for transmitting a torque and/or a rotating movement from the shaft receptacle to the main input shaft of the attachment device. The entrainment elements are in particular configured as entrainment webs which are disposed uniformly on an internal circumference of the receptacle clearance. The shaft receptacle has in particular at least six entrainment webs.

In one advantageous design embodiment, the electrical interface for transmitting a high electric output and/or a high electric current has two output contact sockets of identical type, and for transmitting a low electric output and/or a low electric current has a signal contact socket. On account thereof, an advantageous transmission of power and/or signals between the tool basic module and the attachment device can be implemented. In particular, the output contact sockets and the signal contact sockets are provided for receiving corresponding plug contacts of the attachment device. The output contact sockets and the signal contact socket can in particular be configured as tulip-shaped sockets. A "high output" in this context is to be understood in particular as an output of at least 20 W, preferably an output of at least 40 W, preferably an output of at least 60 W, and particularly preferably an output of at least 80 W. The tool basic module in particular has a power supply which in at least one operating state provides a current for supplying the output contact sockets. Advantageously, the output contact sockets are provided for transmitting a current of at least 2 A. On account thereof, a tool basic module can be used for supplying power to an attachment device. The output contact sockets are preferably provided for transmitting a current of at least 4 A, preferably of at least 10 A, particularly preferably of at least 20 A, and most particularly preferably of at least 25 A. The output contact sockets are in particular provided for transmitting a current between the tool basic module and the attachment device. The output contact sockets are preferably provided for transmitting a current to a power supply of an electric power consumer unit of the attachment device. The output contact sockets are in particular provided for receiving electric power for charging a power accumulator unit of the tool basic module. The output contact sockets are in particular provided for being connected to output plug contacts of a charging device for charging the power accumulator unit of the tool basic module. The connecting of the charging device herein is automatically identified by way of the signal contact socket, and the tool basic module is set to a charging operating state. A "low output" in this context is in particular to be understood to be an output of at most 4 Watts, preferably an output of at most 2 Watts, preferably an output of at most 1 Watt, and particularly preferably an output of at most 0.1 Watt. A "low current" in this context is in particular to be understood to be a current of at most 1000 mA, preferably of at most 500 mA, preferably of at most 100 mA, and particularly preferably of at most 25 mA. The signal contact socket is preferably provided for transmitting a signal, in particular a signal for identifying a type of attachment, and for transmitting operating parameters. In one advantageous design embodiment, the tool basic module has at least one open-loop and/or closed-loop control unit which is provided for evaluating at least one signal of the attachment device that is in particular transmitted by means of the signal contact socket and/or for reading a memory of the attachment device. On account thereof, control and/or process variables can be set specifically for the at least one attachment device. A use of the attachment devices can be optimized. A high operational safety can be achieved. An "open-loop and/or closed-loop control unit" is in particular to be understood to be a unit having at least one control electronics system. A "control electronics system" is in particular to be understood to be a unit having a processor unit and having a memory unit, as well as having an operating software program stored in the memory unit. The open-loop and/or closed-loop control unit is preferably provided for determining a type, a kind, or a variant of the attachment device, in particular by means of evaluating the signal transmitted by means of the signal contact socket. The open-loop and/or closed-loop control unit is preferably provided for activating and/or deactivating the drive unit of the tool basic module as a function of a type, kind, or a variant of the attachment device. It is furthermore proposed that the electrical interface in a coupled state has an electrical resistance of at most 15 mΩ. A link which has a particularly low loss can be achieved on account thereof. A tool basic module for particularly efficient coupling to an attachment device can be provided. An "electrical resistance" of the electrical interface in this context is in particular to be understood to be a contact resistance. The electrical interface in a linked state preferably has a resistance of at most 10 mΩ, preferably of at most 5 mΩ, and particularly preferably of at most 3 mΩ. The signal contact socket is preferably disposed between the two output contact sockets and is oriented so as to be at least substantially perpendicular to said two output contact sockets. An advantageously space-saving disposal of the output contact sockets and of the signal contact sockets can be achieved on account thereof.

It is furthermore proposed that the coupling device of the tool basic module has at least one material clearance which extends along an assembling direction and which while assembling the attachment device is provided for receiving a material protrusion of the attachment device. On account thereof, an advantageously simple alignment of the attachment device in relation to the tool basic module can be enabled when assembling the attachment device on the tool basic module. The clearance is in particular disposed on an external circumference of the housing of the tool basic module. The material clearance has a geometry that is complementary to the material protrusion or the attachment device.

The disclosure furthermore proceeds from an attachment device for use with a tool basic module. The attachment device comprises an operational output, a main input shaft, and a coupling device which for mechanically linking the main input shaft of the attachment device in terms of drive technology has a mechanical interface on a main output shaft of the tool basic module, as well as an electrical interface for electrically coupling to an electrical interface of the tool basic module.

It is proposed that the mechanical interface of the attachment device is configured so as to be substantially annular and has a plurality of form-fitting elements which are disposed uniformly on an internal circumference of the mechanical interface of the attachment device and are provided for torque support on a mechanical interface of the tool basic module. On account thereof, a particularly diverse range of potential uses of a tool basic module can be provided. A high level of comfort for a user and a secure coupling between the attachment device and the tool basic module can be achieved. An advantageous torque support can be achieved.

An "attachment device" in this context is to be understood in particular as a device which is provided for operating with a tool basic module which has a drive unit for a rotary drive and/or a power source, in particular a rechargeable battery. The attachment device is preferably provided for a specific intended use. The attachment device is preferably provided exclusively for operating with a tool basic module. The attachment device is preferably interchangeable with further attachment devices having an identical intended use or having another intended use.

The attachment device furthermore has an operational output which can in particular be configured as a tool receptacle and/or at least as part of a processing tool and/or of a kitchen appliance. A "tool receptacle" is in particular to be understood as a component which is provided for receiving a processing tool in a receptacle region, and in the circumferential direction to establish a form-fitting and/or force-fitting connection to the processing tool. The main input shaft is in particular provided for being at least in part received by the shaft receptacle of the tool basic module. The main input shaft is in particular provided for taking off a torque and/or a rotating movement from the shaft receptacle of the tool basic module. The attachment device can in particular have a gearbox unit which is provided for converting an input torque and/or an input rotating movement. The coupling device of the attachment device has a mechanical interface. The mechanical interface is provided for causing a mechanical link between the attachment device and the main output shaft of the tool basic module in terms of drive technology. The mechanical interface effects in particular a transmission of torque from the shaft receptacle of the tool basic module to the main input shaft of the attachment device. The mechanical interface at the attachment device has in particular one locking unit by way of which the attachment device, in particular a housing of the attachment device, is capable of being connected in a releasable mechanical manner, in particular a tool-free releasable mechanical manner, to the tool basic module, in particular the housing of the tool basic module. The locking unit effects in particular axial securing of the attachment device, in particular of the housing of the attachment device, on the tool basic module, in particular on the housing of the tool basic module. To this end, the locking unit has at least one securing element for axial securing. The at least one securing element for axial securing can in particular be configured as a force-fitting and/or form-fitting securing element. The locking unit furthermore has in particular one unlocking element. The unlocking element is in particular provided for releasing the locking mechanism of the attachment device on the tool basic module. The unlocking element is in particular manually activatable by the user. The unlocking element in an exemplary manner is embodied as a pushbutton. The unlocking element preferably provided on the attachment device.

The mechanical interface is in particular at least in part configured as an annular, in particular at least substantially hollow-cylindrical, appendage of a housing of the attachment device that extends in a direction of main extent of the main input shaft. The mechanical interface of the attachment device is in particular attached to the housing of the attachment device, or is at least in part configured by the housing of the attachment device, and/or is at least in part configured so as to be integral to the housing of the attachment device. In particular, the mechanical interface at least in part configures a collar which in an assembled state is provided for engaging across the mechanical interface of the tool basic module. The mechanical interface of the attachment device has an internal diameter which corresponds, in particular at least substantially, to an external diameter of the mechanical interface of the tool basic module. The mechanical interface of the attachment device has in particular an internal diameter of at least substantially 35 mm, preferably of at least substantially 40 mm, and preferably of at least substantially 45 mm. The form-fitting elements of the mechanical interface of the attachment device for torque support are in particular provided for interacting with corresponding form-fitting elements of the tool basic module. The form-fitting elements are in particular incorporated as material clearances and/or recesses in an internal face of the mechanical sectional face of the attachment device, as material protrusions on an internal face of the mechanical interface of the attachment device, and/or configured as flattenings of an internal face of the mechanical interface of the attachment device. In particular, the mechanical interface of the attachment device can have a plurality of form-fitting elements of identical type. The mechanical interface of the attachment device preferably has form-fitting elements of different types. The form-fitting elements extend in particular so as to be parallel with a direction of main extent of the main drive shaft. In particular, the mechanical interface of the attachment device has at least two form-fitting elements of identical type, and at least one form-fitting element which is different from the two form-fitting elements of identical type. The form-fitting elements extend across an entire extent of the mechanical interface of the attachment device, in particular along a direction of main extent of the main drive shaft.

The coupling device of the attachment device has an electrical interface for transmitting an electric output and/or an electric current. The electrical interface of the attachment device is configured so as to correspond to the electrical interface of the tool basic module, so as to effect an electric link between the attachment device and the tool basic module. The electrical interface of the attachment device has in particular at least one contact element for electrically contacting the attachment device and the tool basic module.

It is furthermore proposed that the mechanical interface of the attachment device has three form-fitting elements which are disposed so as to be in each case offset by 120° on the internal circumference of the mechanical interface of the attachment device. On account thereof, an advantageous alignment of the attachment device on the tool basic module, and an advantageously reliable torque support, in particular an advantageous distribution of force, can be achieved. In particular, twisting of the attachment device relative to the tool basic module can be advantageously prevented. The mechanical interface of the attachment device has in particular two form-fitting elements of identical type which are configured as material protrusions on the internal face of the mechanical interface of the attachment device. In particular, the two form-fitting elements of identical type are configured as ribs. In particular, the ribs have a thickness of at least 1.5 mm, preferably of at least 2 mm, and particular preferably of at least 3 mm. Alternatively, the two form-fitting elements of identical type can have an at least substantially triangular cross-section that is complementary to the cross section of the two form-fitting elements of identical type of the tool basic module. The two form-fitting elements of identical type are in particular provided for being received in two form-fitting elements of the tool basic module of corresponding configuration. The mechanical interface of the attachment device furthermore has a form-fitting element that is configured as a flattening of the internal face of the mechanical interface. In particular, the form-fitting element configured as a flattening is provided for bearing on a planar form-fitting element of the tool basic module that is configured in a corresponding manner.

It is furthermore proposed that the mechanical interface of the attachment device has a plurality of locking hooks which are provided for engaging in locking openings on the mechanical interface of the tool basic module. An advantageously simple and/or secure fastening of the attachment device to the tool basic module can be achieved on account thereof. The mechanical interface of the attachment device has in particular a number of locking hooks that corresponds to a number of locking openings of the tool basic module. The mechanical interface of the attachment device preferably has three locking hooks which are disposed so as to be in each case mutually offset by 90° about the main input shaft of the attachment device. In particular, the locking hooks in an assembled state of the attachment device are provided for engaging in each case behind one locking edge of the locking openings of the tool basic module.

It is moreover proposed that the electrical interface of the attachment device for transmitting a high electric output and/or a high electric current has two output plug contacts of identical type, and for transmitting a low electric output and/or a low electric current has a signal plug contact. The signal plug contact of the attachment device is preferably disposed between the two output plug contacts of the attachment device and is oriented so as to be at least substantially perpendicular to said two output plug contacts. On account thereof, an advantageous transmission of power and/or signals between the tool basic module and the attachment device can be implemented.

It is furthermore proposed that the coupling device of the attachment device has at least one material protrusion which extends along an assembling direction and which while assembling the attachment device is provided for engaging in a material clearance of the tool basic module. On account thereof, an advantageously simple alignment of the attachment device in relation to the tool basic module can be enabled when assembling the attachment device on the tool basic module. The material protrusion is in particular disposed on an external circumference of the housing of the attachment device. The material protrusion has a geometry that is complementary to the material clearance of the tool basic module.

Furthermore proposed is a hand-held power tool system having a tool basic module according to the disclosure and having at least one attachment device which is provided for mechanically linking to the tool basic module in terms of drive technology and/or electrically linking to the tool basic module. On account thereof, a hand-held power tool system having a particularly large range of applications can be provided. A range of application can advantageously be expanded by attachment devices. The hand-held power tool system preferably comprises at least one further attachment device, preferably at least three attachment devices.

The tool basic module according to the disclosure, the hand-held power tool system, and the attachment device herein are not to be limited to the application and embodiment described above. In particular, in order to implement a mode of operation described herein, the tool basic module according to the disclosure, the hand-held power tool system, and the attachment device may have a number of individual elements, components and units differing from a number stated herein. In addition, in the case of the value ranges indicated in this disclosure, values lying within the limits mentioned are also intended to be disclosed and considered to be usable as desired.

BRIEF DESCRIPTION OF THE DRAWINGS

Further advantages are derived from the following description of the drawings. An exemplary embodiment of the disclosure is illustrated in the drawings. The drawings, the description, and the claims include numerous features in combination. The person skilled in the art will expediently also consider the features individually and combine said features so as to form further meaningful combinations.

In the drawings.

DETAILED DESCRIPTION

Figure 1:
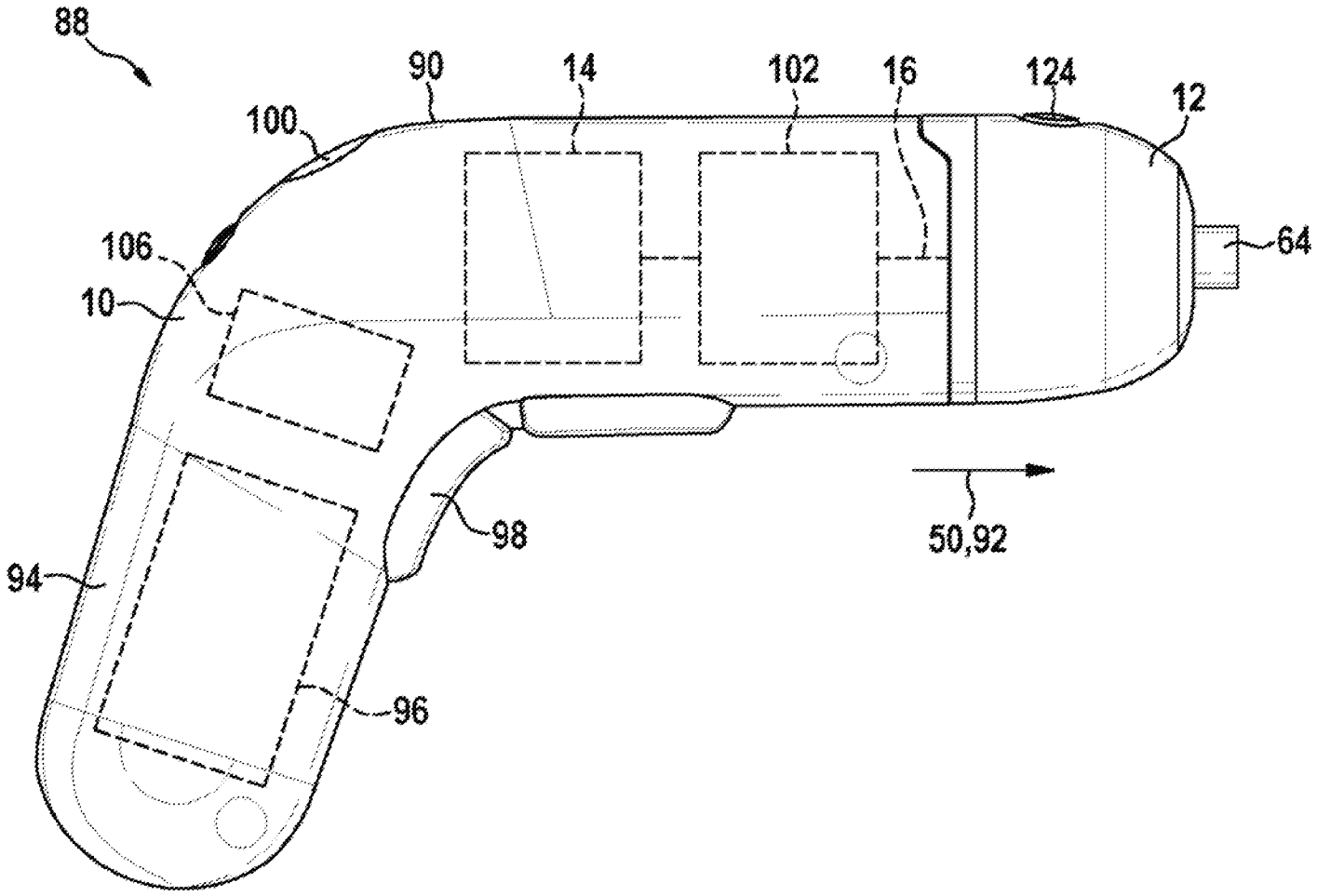
FIG. 1 shows a view of a hand-held power tool system having a tool basic module and an attachment device.

FIG. 1 shows a hand-held power tool system 88 having a tool basic module 10 and having an attachment device 12 which is provided for mechanically linking in terms of drive technology and/or electrically linking to the tool basic module 10. The tool basic module 10, conjointly with the attachment device 12 coupled to the tool basic module 10, is provided for configuring a fully functional hand-held power tool. The tool basic module 10 is provided exclusively for use with at least one attachment device 12 and thus is not provided for a stand-alone use.

The tool basic module 10 has a drive unit 14. The drive unit 14 is configured as an electric motor. The tool basic module 10 has a housing 90 which in an assembled state mounts the drive unit 14 and protects the latter from environmental influences such as dust, moisture, radiation, and/or shocks. The tool basic module 10 has a main operating direction 92. The housing 90 of the tool basic module 10 in the present exemplary embodiment is configured in the shape of a pistol. The housing 90 at an end oriented counter to the main operating direction 92 has a handle 94. The handle 94 in a use of the hand-held power tool system 88 is provided for being gripped by a hand of a user. The tool basic module 10 has a mass of less than 500 g. The tool basic module 10 has a mass of at least substantially 300 g.

The tool basic module 10 has a power supply 96. The power supply 96 in the present exemplary embodiment comprises an electric power accumulator. The electric power accumulator in the present exemplary embodiment is configured as a rechargeable battery. The electric power accumulator in the present exemplary embodiment is configured as a lithium-ion battery. The hand-held power tool system 88 comprises a charging unit (not illustrated in more detail) which is connectable to a mains supply and which is provided for charging the electric energy accumulator. Alternatively, the power supply 96 can be provided for connecting the drive unit 14 directly to a mains supply. It is also conceivable for the power supply to have a receptacle for single-use batteries as energy accumulators.

The tool basic module 10 comprises a main switch 98 which is provided for switching on, switching off the drive unit 14, and/or setting a rotating speed and/or a torque of the drive unit 14. The tool basic module 10 furthermore comprises a mode selector switch 100 which is provided for setting an operating mode, for example a rotation direction, a torque, a rotating speed, and/or a soft start or the like of the drive unit 14.

Figure 2:
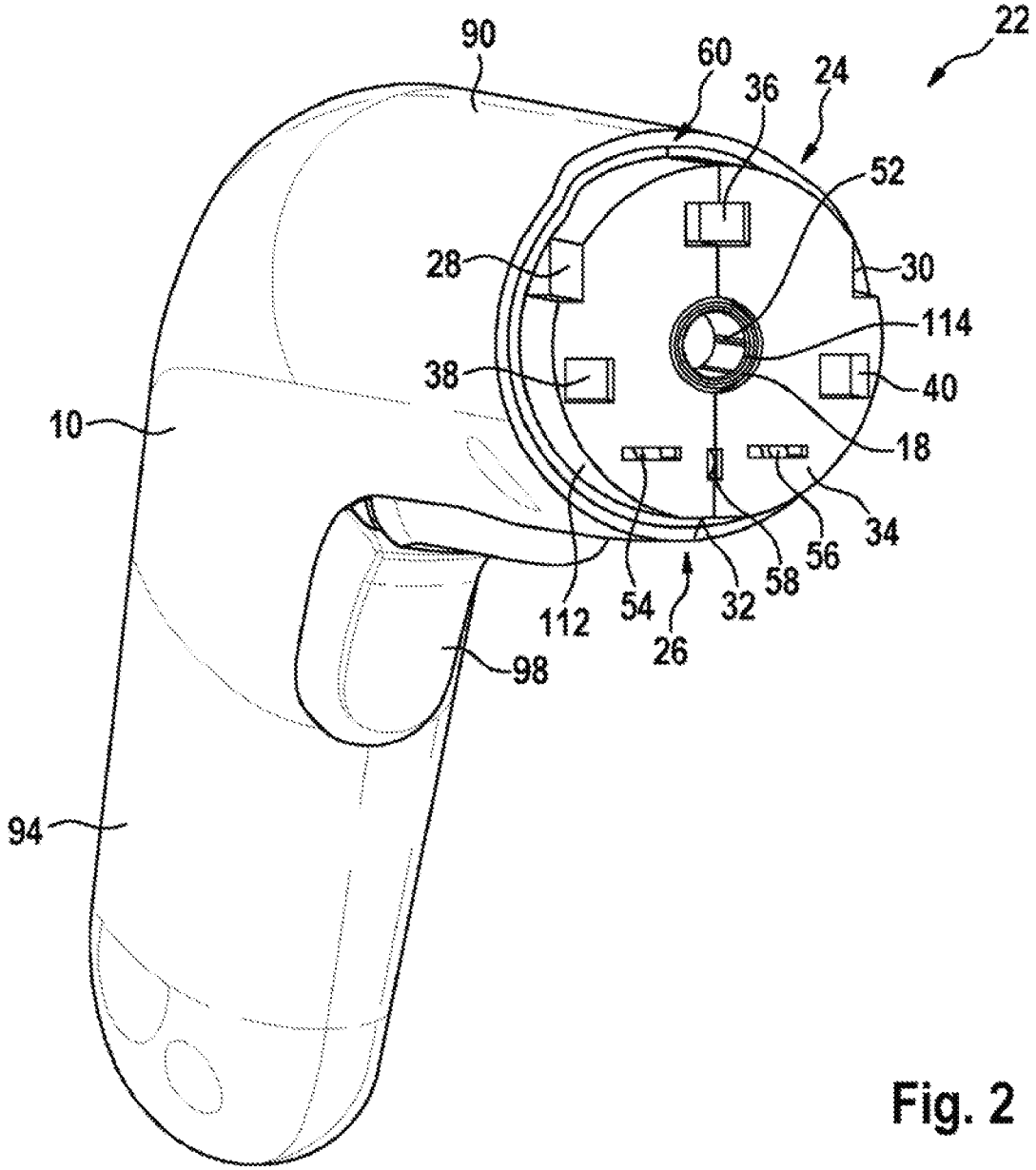
FIG. 2 shows a perspective view of the tool basic module without an attachment device.
Figure 3:
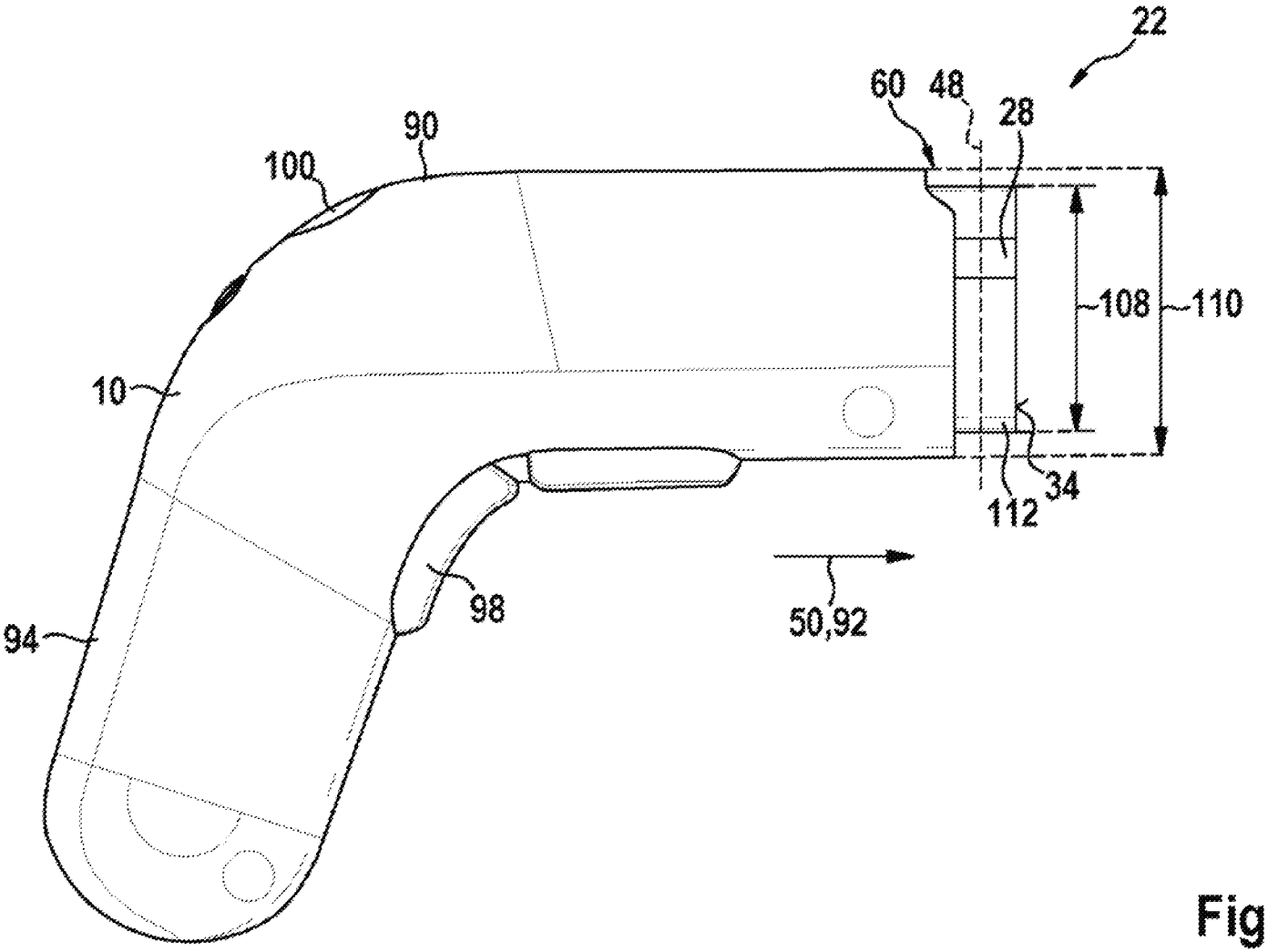
FIG. 3 shows a lateral view of the tool basic module without an attachment device.
Figure 4:
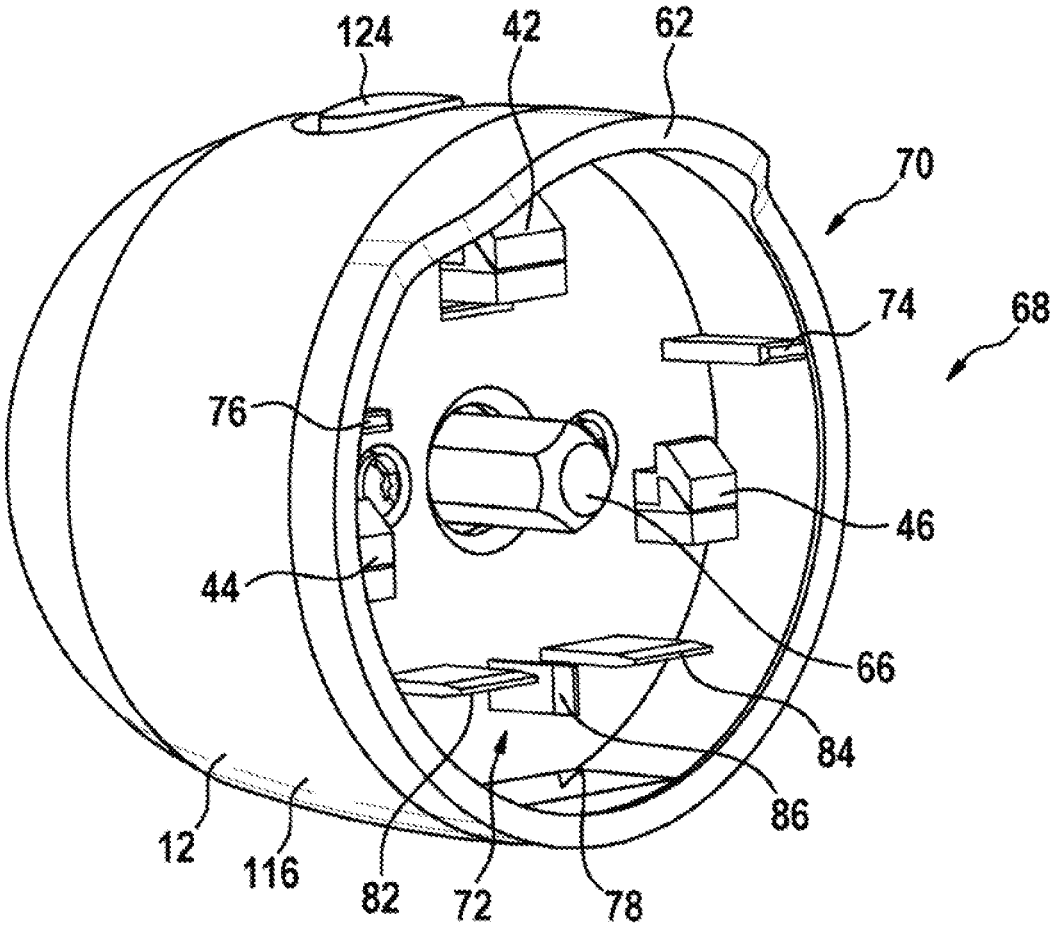
FIG. 4 shows a perspective view of the attachment device.
Figure 5:
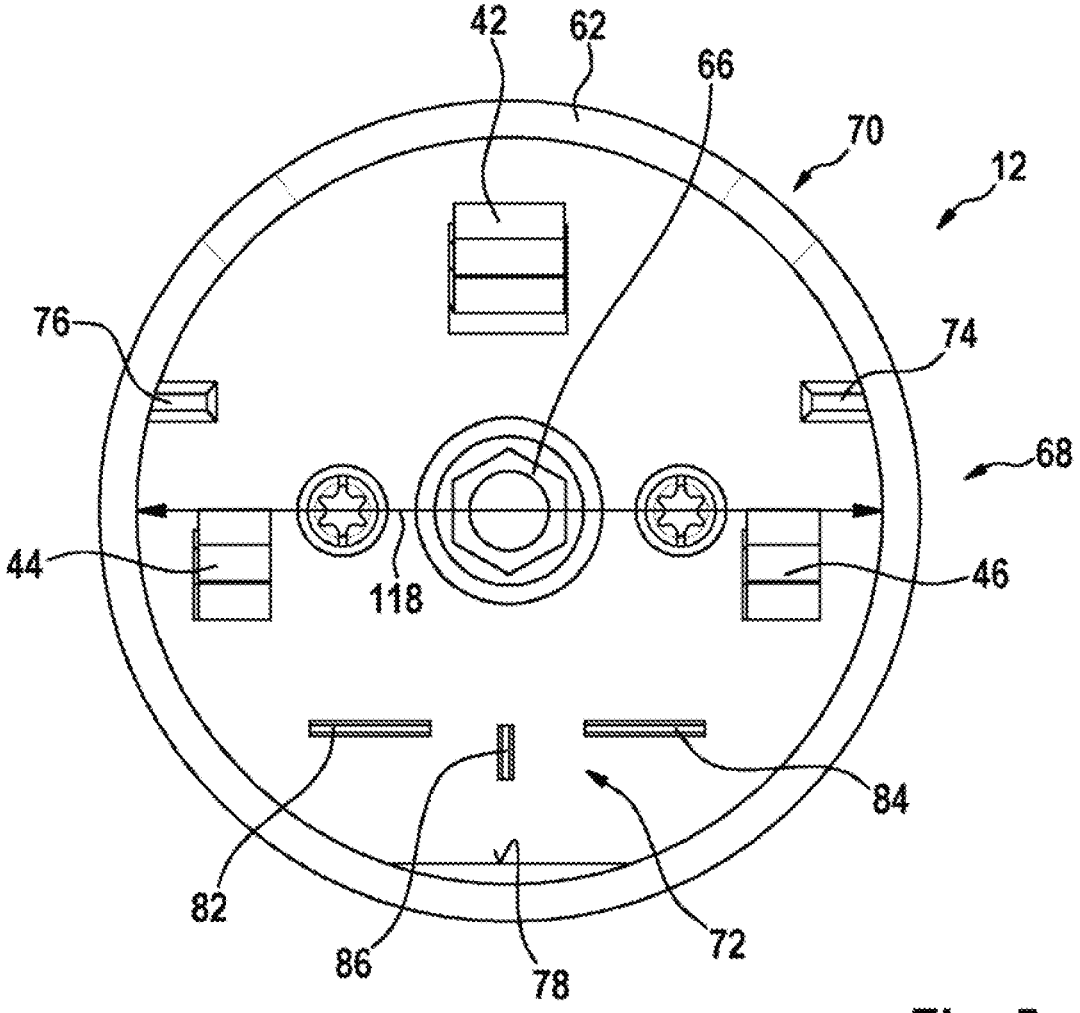
FIG. 5 shows a rear view of the attachment device.

FIG. 2 shows a perspective view of the tool basic module 10 without the attachment device 12. FIG. 3 shows a lateral view of the tool basic module 10 without the attachment device 12. The tool basic module 10 comprises a coupling device 22 which for mechanically linking in terms of drive technology the attachment device 12 has a mechanical interface 24 on the main output shaft 16. The attachment device 12 has a mechanical interface 70 that corresponds to the mechanical interface 24 (cf. FIG. 4). The tool basic module 10 furthermore has a main output shaft 16 having a shaft receptacle 18. The shaft receptacle 18 is preferably configured so as to be integral to a main output shaft 16 of the tool basic module 10. The coupling device 22 has at least one material clearance 60 which extends along an assembling direction and which while assembling the attachment device 12 is provided for receiving a material protrusion 62 of the attachment device 12. The material clearance 60 has a geometry that is complementary to the material protrusion 62 of the attachment device 12. The material clearance 60 in combination with the material protrusion 62 serves as an orientation aid for aligning the attachment device 12 relative to the tool basic module 10 when assembling the attachment device 12 on the tool basic module 10.

The tool basic module 10 can be used as a hand-held power tool exclusively in conjunction with the attachment device 12. The tool basic module 10 per se cannot be used without an attachment device 12. The drive unit 14 in at least one operating state drives the main output shaft 16 having a shaft receptacle 18 in particular exclusively in the case of a coupled attachment device 12. The shaft receptacle 18 has a receptacle clearance 52 which extends along the direction of main extent 50 of the main output shaft 16 and which has a diameter of at most 7 mm. The receptacle clearance 52 has an at least substantially circular cross-section having a diameter of at most 7 mm. The receptacle clearance 52 has in particular a plurality of entrainment elements 114 which are disposed on an internal circumference of the receptacle clearance 52 and are provided for transmitting a torque and/or a rotating movement from the shaft receptacle 18 to a main input shaft 66 of the attachment device. The entrainment elements 114 in the present exemplary embodiment are configured as entrainment webs which are disposed uniformly on an internal circumference of the receptacle clearance 52. The shaft receptacle has in particular at least six entrainment elements 114. The tool basic module 10 in the present exemplary embodiment has a gearbox unit 102 which is provided for converting a torque and/or a rotating movement of the drive unit 14 to a torque and/or a rotating movement of the main output shaft 16. The gearbox unit 102 can have a fixedly set transmission ratio. Alternatively, it is conceivable for the gearbox unit 102 to be configured so as to be switchable. The drive unit 14 in at least one operating state provides a torque at shaft receptacle 18. The tool basic module 10 is provided so as to be manually held when in use. The tool basic module 10 has a handle 94. The handle 94 is configured so as to be integral to the housing 90 of the tool basic module 10.

The mechanical interface 24 is configured so as to be at least in particular substantially cylindrical, and has a plurality of form-fitting elements 28, 30, 32 which are disposed in particular uniformly on an external circumference of the mechanical interface 24 and are provided for torque support of the attachment device 12. The form-fitting elements 28, 30, 32 of the mechanical interface 24 of the tool basic module 10 for torque support are provided in particular for interacting with corresponding form-fitting elements 74, 76, 78 of the attachment device 12. The form-fitting elements 28, 30, can in particular be incorporated as material clearances and/or recesses in a shell face 112 of the mechanical interface 24, as material protrusions on a shell face 112 of the mechanical interface 24, and/or be configured as flattenings of a shell face 112 of the mechanical interface 24. The mechanical interface 24 in the present exemplary embodiment has three form-fitting elements 28, 30, 32 which are disposed so as to be in each case offset by 120° on the external circumference of the mechanical interface 24. In the present exemplary embodiment, the mechanical interface 24 has two form-fitting elements 28, 30 of identical type, which are configured as material clearances or recesses in the shell face 112 of the mechanical interface 24. The two form-fitting elements 28, 30 of identical type have an at least substantially triangular cross-section. The two form-fitting elements 28, 30 of identical type are provided for receiving two form-fitting elements 74, 76 of the attachment device 12 that are configured in a corresponding manner. The mechanical interface 24 furthermore has one form-fitting element 32 that is configured as a flattening of the shell face 112 of the mechanical interface 24. In particular, the form-fitting element 32 configured as a flattening is provided for bearing on a planar form-fitting element 78 of the attachment device 12 that is configured in a corresponding manner.

The mechanical interface 24 has an end face 34 which runs so as to be at least substantially perpendicular to the main output shaft 16 and in which a plurality of locking openings 36, 38, 40 which are provided for receiving locking hooks 42, 44, 46 of the attachment device 12 are disposed. The mechanical interface 24 in the present exemplary embodiment has an end face 34 which runs so as to be substantially perpendicular to the main output shaft 16 and in which three locking openings 36, 38, 40 which are disposed so as to be in each case offset by 90° about the main output shaft 16 are disposed. All interface elements of the mechanical interface 24, of the electrical interface 26, and the shaft receptacle 18 terminate so as to be at least substantially flush with the end face 34. All interface elements of the mechanical interface 24 and of the electrical interface 26 are at least in part disposed in a plane 48 which intersects the shaft receptacle 18 and which runs so as to be at least substantially perpendicular to the main output shaft 16.

The mechanical interface 24 has a diameter 108 which is smaller in comparison to a maximum diameter 110 of a part of the housing 90 of the tool basic module 10 that extends along the direction of main extent 50 of the main output shaft 16. The mechanical interface 24 has in particular a diameter 108 which is smaller by at least 2 mm, preferably at least 5 mm, and preferably at least 8 mm than the maximum diameter 110 of the part of the housing 90 of the tool basic module 10 that extends along the direction of main extent 50 of the main output shaft 16. The part of the housing 90 of the tool basic module 10 that extends along the direction of main extent 50 of the main output shaft 16 has in particular a maximum diameter 110 of at least substantially 40 mm, preferably of at least substantially 45 mm, and preferably of at least substantially 50 mm. The mechanical interface 24 has in particular a diameter 108 of at least substantially 35 mm, preferably of at least substantially 40 mm, and preferably of at least substantially 45 mm.

The electrical interface 26 is provided for electrically linking the attachment device 12 on the tool basic module 10, in a manner coupled to the mechanical linking. In the present exemplary embodiment the hand-held power tool system 88 has an attachment device 12 which in an exemplary manner is configured as a screwdriver attachment. It is conceivable for the hand-held power tool system 88 to comprise further attachment devices of further types.

The electrical interface 26 for transmitting a high electric output and/or a high electric current has two output contact sockets 54, 56 of identical type, and for transmitting a low electric output and/or a low electric current has a signal contact socket 58. The output contact sockets are provided for transmitting an electric output from the tool basic module 10 to the attachment device 12. The output contact sockets 54, 56 are provided for transmitting a current of at least 20 A. The output contact sockets 54, 56 are provided for transmitting an output of at least 100 Watts. It is conceivable for the output contact sockets 54, 56 to be provided for transmitting a higher current and/or a higher output of, for example, 30 A and/or 500 Watts. The output contact sockets 54, 56 in a coupled state have an electrical resistance of at most 15 mΩ. The output contact sockets 54, 56 in a coupled state have an electrical resistance of at most 12 mΩ.

The signal contact socket 58 is provided for further electrical linking of the attachment device 12 on the tool basic module 10, said electrical linking being coupled to the mechanical linking. The signal contact socket 58 is provided for transmitting an electric output and/or an electric signal between the tool basic module 10 and the attachment device 12. The signal contact socket 58 is provided for transmitting a current of at most 25 mA. It is conceivable for the signal contact socket 58 to be provided for transmitting a current of up to 1 A. It is conceivable for the electrical interface 26 in an alternative design embodiment to include only the output contact sockets 54, 56.

The attachment device 12 configured as a screwdriver attachment is provided for mechanically linking in terms of drive technology and electrically linking to the tool basic module 10. The attachment device 12 has a main input shaft 66 and a coupling device 68 which has a mechanical interface 70 for mechanically linking the main input shaft 66 in terms of drive technology on the main output shaft 16 of the tool basic module 10, as well as an electrical interface 72 for electrically coupling to an electrical interface 26 of the tool basic module 10. The mechanical interface 70 is in particular configured as an annular, in particular at least substantially hollow-cylindrical, appendage of a housing 116 of the attachment device 12. The mechanical interface 70 of the attachment device 12 is in particular attached to the housing 116 of the attachment device 12, or is at least in part configured by the housing 116 of the attachment device 12, and/or is at least in part configured so as to be integral to the housing 116 of the attachment device 12. The mechanical interface 70 configures a collar which in an assembled state is provided for engaging across the mechanical interface 24 of the tool basic module 10. The mechanical interface 70 of the attachment device 12 has an internal diameter 118 which in particular at least substantially corresponds to a diameter 108 of the mechanical interface 70 of the tool basic module 10. The mechanical interface 70 of the attachment device 12 has in particular an internal diameter of at least substantially 35 mm, preferably of at least substantially 40 mm, and preferably of at least substantially 45 mm. The coupling device 68 has at least one material protrusion 62 which extends along an assembling direction and which while assembling is provided for engaging in a material clearance 60 of the tool basic module 10. The material clearance 60 in combination with the material protrusion 62 serves as an orientation aid for aligning the attachment device 12 relative to the tool basic module 10 when assembling the attachment device 12 on the tool basic module 10. The mechanical interface 70 of the attachment device 12 is configured so as to correspond to the mechanical interface 24 of the tool basic module 10.

The mechanical interface 70 of the attachment device 12 in the present exemplary embodiment has three form-fitting elements 74, 76, 78 which are disposed so as to be in each case offset by 120° on the internal circumference 80 of the mechanical interface 70 of the attachment device 12. The mechanical interface 70 of the attachment device 12 has two form-fitting elements 74, 76 of identical type, which are configured as material protrusions on the internal face of the mechanical interface 70 of the attachment device 12. The two form-fitting elements 74, 76 of identical type are configured as ribs. The two form-fitting elements 74, 76 of identical type are provided for being received in two form-fitting elements 28, 30 of the tool basic module 10 that are configured in a corresponding manner. The mechanical interface 70 of the attachment device 12 furthermore has a form-fitting element 78 which is configured as a flattening of the internal face of the mechanical interface 70. The form-fitting element 78 configured as a flattening is provided for bearing on a planar form-fitting element 32 of the tool basic module 10 that is configured in a corresponding manner.

The mechanical interface 70 of the attachment device 12 has a plurality of locking hooks 42, 44, 46 which are provided for engaging in the locking openings 36, 38, 40 of the mechanical interface 24 of the tool basic module 10. The mechanical interface 70 of the attachment device 12 in the present exemplary embodiment has three locking hooks 42, 44, 46 which are disposed so as to be in each case offset by 90° about the main input shaft 66.

The main input shaft 66 is provided for transmitting a torque from the main output shaft 16 of the tool basic module 10 to the attachment device 12. The main input shaft 66 of the attachment device 12 in the present exemplary embodiment is configured as a hexagonal shaft. Alternatively, the main input shaft 66 can be configured as a shaft having any arbitrary polygonal cross-section. The main input shaft 66 in the embodiment illustrated is provided for connecting in a rotationally fixed manner to the shaft receptacle 18 of the tool basic module 10. The main input shaft 66, for coupling the attachment device 12 in terms of drive technology to the tool basic module 10, is provided for engaging at least in part in the receptacle clearance 52 of the shaft receptacle 18. The attachment device 12 has an operational output 64 in the form of a tool receptacle 104 which is provided for receiving an insert tool such as, for example, a screwdriver bit, a brush, or a mixer.

The attachment device 12 has an electrical interface 72 which is configured so as to correspond to the electrical interface 24 of the tool basic module 10. The electrical interface 72 for transmitting a high electric output and/or a high electric current has two output plug contacts 82, 84 of identical type, and for transmitting a low electric output and/or a low electric current has a signal plug contact 86. The signal plug contact 86 is disposed between the two output plug contacts 82, 84 and oriented so as to be at least substantially perpendicular to said two output plug contacts 82, 84. The output plug contacts 82, 84 and the signal plug contact 86 are disposed completely within the collar formed by the mechanical interface 72 of the attachment device 12. On account thereof, damage to, in particular bending of, the output plug contacts 82, 84 and the signal plug contact can be at least largely prevented, for example when the attachment device 12 is dropped.

The tool basic module 10 comprises at least one open-loop and/or closed-loop control unit 106 which is provided for evaluating at least one operating parameter of the drive unit 14, said operating parameter being in particular transmitted from the attachment device 12 to the tool basic module 10 by way of the signal plug contact 86 and the signal contact socket 58. The operating parameter is preferably a memorized value read from a memory, for example an EEPROM, of the attachment device 12. In particular, a plurality of operating parameters can be read from the memory of the attachment device. The operating parameter can be, for example, a maximum rotating speed, a maximum torque, a rotation direction, or the like, of the drive unit 14. In particular, the operating parameters in the memory of the attachment device 12 are specific to the respective type of the attachment device 12.

The open-loop and/or closed-loop control unit 106 in at least one operating state controls in an open-loop and/or closed-loop manner a power supply of the drive unit 14 and/or power supply of the electrical interface 26 as a function of the value of the key indicator. For example, the open-loop and/or closed-loop control unit 106 as a function of the type of the coupled attachment device 12 establishes control variables and/or process variables such as, for example, limit values of an output supplied to the drive unit 14, limit values of an output, of a torque and/or a rotating speed, said output, torque and/or rotating speed being transmitted by way of the main output shaft 16. The open-loop and/or closed-loop control unit 106 as a function of the type of the coupled attachment device 12 establishes control variables and/or process variables for the output contact sockets 54, 56, such as limit values of an output, of a current and/or of a voltage, for example.

Figure 6:
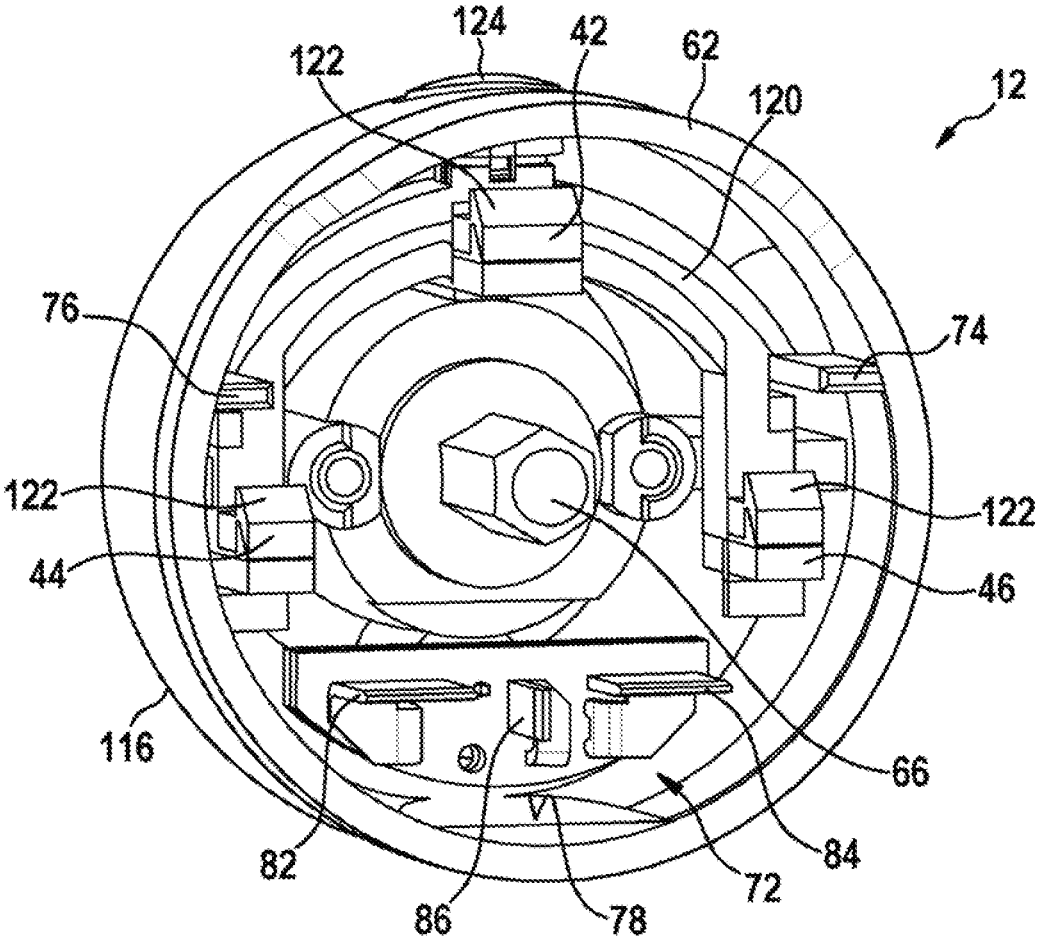
FIG. 6 shows a rear view of the attachment device in the opened state.

FIG. 6 shows the attachment device 12 having an opened rear side. The locking hooks 42, 44, 46 are collectively disposed on a displacement element 120. The displacement element 120 in the embodiment illustrated is configured in the manner of a semi-circular bracket, the locking hooks 44, 46 being disposed at the free end of the latter. The locking hook 42 is provided so as to be substantially centric on the bracket-shaped displacement element 120. A linear displacement of the displacement element 120 leads to an identical linear movement of all locking hooks 120. The displacement element 120 by means of a compression spring (not visible here) is mounted in a resilient manner in the housing 116 of the attachment device 12. The compression spring is provided for impinging the displacement element 120 with a spring force which is provided for holding the locking hooks 42, 44, 46 in a locking position. The locking hooks 42, 44, 46 having in each case one introduction ramp 122. When assembling, the locking hooks 42, 44, 46 when being introduced into the locking openings 36, 38, 40 of the tool basic module 10 by virtue of the introduction ramp 122 are displaced into the unlocking position counter to the spring force of the compression spring. In the course of being further introduced into the locking openings 36, 38, 40 of the tool basic module 10, the locking hooks 42, 44, 46 latch into the locking openings 36, 38, 40, wherein the locking hooks 42, 44, 46 on account of the spring force of the compression spring are moved to the locking position. The attachment device 12 has an unlocking button 124 for releasing the attachment device from the tool basic module 10. The unlocking button 124 is configured as a pushbutton. The unlocking button 124 is operatively coupled to the displacement element 120. When the unlocking button. 124 is activated, a linear movement of the displacement element 120 takes place counter to the spring force of the compression spring, on account of which the locking hooks 42, 44, 46 are moved to the unlocking position. Releasing the attachment device 12 from the tool basic module 10 is enabled on account thereof.

The invention claimed is:

1. A tool basic module for use with at least one attachment device, said tool basic module comprising:

a drive unit;

a main output shaft having a shaft receptacle configured to at least in part receive a main input shaft of the attachment device; and a coupling device including:

a mechanical interface on the main output shaft configured to mechanically link to the attachment device in terms of drive technology; and an electrical interface configured to transmit at least one of an electric output and an electric current to the attachment device, wherein the mechanical interface is at least substantially cylindrical and has a plurality of form-fitting elements disposed uniformly on an external circumference of the mechanical interface, the form-fitting elements configured to support a torque of the attachment device, and wherein all interface elements of the mechanical interface and of the electrical interface are at least in part disposed in a plane that intersects the shaft receptacle and runs at least substantially perpendicular to the main output shaft.

2. The tool basic module as claimed in claim 1, wherein the plurality of form-fitting elements includes three form-fitting elements disposed offset from one another by 120° on the external circumference of the mechanical interface.

3. The tool basic module as claimed in claim 1, wherein the mechanical interface has at least one end face extending at least substantially perpendicular to the main output shaft, the at least one end face defining a plurality of locking openings configured to receive locking hooks of the attachment device.

4. The tool basic module as claimed in claim 1, wherein the mechanical interface has at least one end face extending at least substantially perpendicular to the main output shaft, the at least one end face defining three locking openings offset from one another by 90° about the main output shaft.

5. The tool basic module as claimed in claim 1, wherein the mechanical interface has at least one end face extending at least substantially perpendicular to the main output shaft, wherein all interface elements of the mechanical interface and/or of the electrical interface and/or the shaft receptacle terminate so as to be at least substantially flush with the end face.

6. The tool basic module as claimed in claim 1, wherein the shaft receptacle defines a receptacle clearance extending along a direction of main extent of the main output shaft and which has a diameter of at most 7 mm.

7. The tool basic module as claimed in claim 1, wherein the coupling device defines at least one material clearance extending along an assembling direction and configured to receive a material protrusion of the attachment device during assembly of the attachment device.

8. A tool basic module for use with at least one attachment device, said tool basic module comprising:

a drive unit;

a main output shaft having a shaft receptacle configured to at least in part receive a main input shaft of the attachment device; and a coupling device including:

a mechanical interface on the main output shaft configured to mechanically link to the attachment device in terms of drive technology; and an electrical interface configured to transmit at least one of an electric output and an electric current to the attachment device, wherein the mechanical interface is at least substantially cylindrical and has a plurality of form-fitting elements disposed uniformly on an external circumference of the mechanical interface, the form-fitting elements configured to support a torque of the attachment device, and wherein the electrical interface includes two output contact sockets of identical type configured to transmit a high electric output of at least 20 W and/or a high electric current of at least 2 A, and a signal contact socket configured to transmit a low electric output of at most 4 W and/or a low electric current of at most 1 A.

9. The tool basic module as claimed in claim 8, wherein all interface elements of the mechanical interface and of the electrical interface are at least in part disposed in a plane that intersects the shaft receptacle and runs at least substantially perpendicular to the main output shaft.

10. The tool basic module as claimed in claim 8, wherein the signal contact socket is disposed between the two output contact sockets and is oriented at least substantially perpendicular to said two output contact sockets.

11. An attachment device for use with a tool basic module, said attachment device comprising:

an operational output;

a main input shaft; and a coupling device including:

a mechanical interface on a main input shaft configured to mechanically linking the main input shaft in terms of drive technology to a main output shaft of the tool basic module; and an electrical interface configured to electrically couple to an electrical interface of the tool basic module, wherein the mechanical interface is at least substantially annular and has a plurality of form-fitting elements disposed uniformly on an internal circumference of the mechanical interface and are provided for torque support on a mechanical interface of the tool basic module, wherein the electrical interface has two output plug contacts configured to transmit a high electric output of at least 20 W and/or a high electric current of at least 2 A, and a signal plug contact configured to transmit a low electric output of at most 4 W and/or a low electric current of at most 1 A, and wherein the signal plug contact is disposed between the two output plug contacts and is oriented at least substantially perpendicular to said two output plug contacts.

12. The attachment device as claimed in claim 11, wherein the plurality of form-fitting elements includes three form-fitting elements disposed offset from one other by 120° on an internal circumference of the mechanical interface.

13. The attachment device as claimed in claim 11, wherein the mechanical interface has a plurality of locking hooks configured to engage in locking openings of the mechanical interface of the tool basic module.

14. The attachment device as claimed in claim 11, wherein the mechanical interface has three locking hooks disposed offset from one another by 90° about the main input shaft.

15. The attachment device as claimed in claim 11, wherein the coupling device has at least one material protrusion extending along an assembling direction and configured to engage in a material clearance of the tool basic module during assembly.

* * * * *